United States Patent [19]

Beier

[11] 4,439,652

[45] Mar. 27, 1984

[54] CONTACT SYSTEM FOR GAS BLAST CIRCUIT BREAKERS

[75] Inventor: Helmut Beier, Berlin, Fed. Rep. of Germany

[73] Assignee: Siemens AG, Berlin and Munich, Fed. Rep. of Germany

[21] Appl. No.: 391,101

[22] Filed: Jun. 23, 1982

[30] Foreign Application Priority Data

Jul. 2, 1981 [DE] Fed. Rep. of Germany ..... 3126744

[51] Int. Cl.[3] ..... H01H 33/70; H01H 33/12

[52] U.S. Cl. ..... 200/148 A; 200/146 R

[58] Field of Search ..... 200/148 A, 146 R

[56] References Cited

U.S. PATENT DOCUMENTS

| | | | |
|---|---|---|---|
| 3,639,712 | 2/1972 | Balmat et al. | 200/148 A |
| 3,786,215 | 1/1974 | Mauthe | 200/148 A |
| 4,015,095 | 3/1977 | Bitsch et al. | 200/147 R |
| 4,296,288 | 10/1981 | Yanabu et al. | 200/148 A |

*Primary Examiner*—Robert S. Macon

*Attorney, Agent, or Firm*—Karl F. Milde, Jr.; Andrew G. Rodau

[57] ABSTRACT

A contact system for a gas blast circuit breaker has a nozzle-shaped fixed first contact piece, a coaxially mounted nozzle-shaped axially movable second contact piece and a movable bridging element common to both contact pieces. Spring biasing serves to urge the end faces of the first and second contact pieces together in the breaker make position. The breaker driving means moves the bridging contact piece out of a position of electrical connection between the first and second contact pieces during the breaking process, before the second contact is separated from the first contact. The arc at breaking is thus drawn only between the first and second contact pieces which are fitted with graphite electrodes to resist burn-off. This protects the current paths which are intended to carry the rated current and the short circuit current in the make position from damage due to arcing. And since the contact elements of the bridging contact piece which transfer the rated current do not participate in guiding the arc, the dielectric strength of the arc gap is increased.

8 Claims, 2 Drawing Figures

CONTACT SYSTEM FOR GAS BLAST CIRCUIT BREAKERS

BACKGROUND OF THE INVENTION

1. Field of the Invention

The invention relates to a contact system for gas blast circuit breakers with a nozzle-shaped fixed contact piece; a second, coaxially mounted nozzle-shaped, axially movable contact piece; and a movable bridging contact piece common to both.

2. Description of the Prior Art

A contact system of this type is disclosed in Canadian Pat. No. 1,035,817 (which corresponds to German Auslegeschrift DE-AS No. 24 44 943), wherein one nozzle-shaped contact piece, from which the bridging contact rolls off, is axially movable against the force of a spring in the direction of another nozzle-shaped contact piece which is fixed, and is connected with the secondary coils of two electrodynamically acting coil systems.

In the known gas blast circuit breaker, the switching work is reduced in that electrodynamic control of the roll-off switch element is achieved. This is done in that at sufficiently high currents the switch switches quasi-synchronously. During the break process, the current to be broken, flowing in a first coil system, initially produces a high repulsive force, by which the roll-off contact piece is accelerated in the direction of the other nozzle-shaped element, so that the gap is reduced. Shortly before the current to be broken passes through zero, this force changes to an attracting force, increasing the gap, because of the specifically chosen phase angle in the first coil system. Consequently, the necessary quenching distance between the two nozzle-shaped contact pieces is achieved during passage through zero.

It is further known from U.S. Pat. No. 4,258,239 (which corresponds to German AS No. 27 03 550) that a second nozzle-shaped contact piece can be associated with a first fixed nozzle-shaped contact piece, with the second contact piece being movable between a quench position near the first contact piece and a gap position remote therefrom. The second nozzle-shaped contact piece is held in the quench position outside the break position by the force of a spring, and in the course of the break motion it is brought from that position into the break position against the force of the spring by the switch drive via a driving member.

In both switch embodiments, as in all known double-nozzle contact systems with a bridging contact piece, the arc is initially drawn during the breaking process between the one nozzle-shaped switch element, the so-called roll-off contact piece, and the bridging contact piece. As the breaking process continues, the arc is switched from the bridging contact piece to the second nozzle-shaped contact piece. The metallic contact devices required for transferring the rated current, notable at the bridging contact piece, participate in guiding the arc, so that under the influence of the arc metal vapors get into the gap. Such vapors may impair the dielectric strength of the gas gap between the open contacts when the arc is quenched during the natural passage of the alternating current through zero.

SUMMARY OF THE INVENTION

It is an object of the invention to provide a contact system for a gas blast circuit breaker wherein the contact elements provided for transmission of the rated current do not participate in guiding the arc during the breaking process, thereby permitting an increase in the dielectric strength of the gap.

According to the invention, this is achieved in that in the make position the second contact piece is urged against the first contact piece under spring force, and is transferred during the break process to the break position with delay, by the bridging contact piece rolling off the first contact piece.

By application of the invention, the bridging contact piece intended to guide the rated current in the make position of the gas blast circuit breaker is moved first. Before the adjacent spring nozzle-shaped contact pieces open, between which the arc is then drawn, the bridging contact piece has already left the region of the opening contacts. In this way, metal of the metallic contact devices provided for guiding the rated current can no longer be evaporated by the arc. Instead, the arc burns between the two nozzle-shaped end faces of the coaxially mounted contact pieces, so that it is drawn in that region, namely preferably at the inner edge of the nozzle bodies, to which in known switches it must first be drawn by a blast of compressed air.

If the two nozzle-shaped contact pieces are provided with graphite bodies on their free end faces designed to contact one another, no substance having a dielectric-reducing effect on the gap will form under the influence of the burning arc, other than graphite vapors and the dissociated quenching and insulating material.

The switching is facilitated because the arc is drawn at the point, namely at the nozzle bodies, where it is to be quenched in the further course of the break process after the quenching distance has been reached. Therefore, it can enter the interior of the nozzles earlier than in known contact systems.

By applying the invention, it is also possible to achieve a large distance between the nozzles, i.e. a large gap, so that with a single interruption point comparatively higher rated voltages can be switched than before, or respectively, higher test voltages can be achieved in the open state.

In a contact system for gas blast circuit breakers according to the invention, with a piston-and-cylinder arrangement to generate a quenching gas flow, the movable bridging contact piece is preferably rigidly connected to the cylinder. The cylinder may be provided in the region of its free end faces with an inner intermediate bottom, which forms with the bridging contact piece an annular gas flow nozzle.

Advantageously, in the position separate from the first contact piece, the second contact piece is electroconductively connected with the bridging contact piece.

The current transfer from the second contact piece to its associated support is thereby effected by the bridging contact piece, so that no additional sliding contacts or current leads are required.

In an advantageous embodiment of the idea of the invention, the bridging contact piece is made sleeve-shaped, and comprises a plurality of spring-loaded contact fingers of different lengths arranged uniformly distributed over the circumference, which bridge these two contact pieces electroconductively just before the second contact piece separates from the first. The contact fingers, of different lengths, facilitate the switching of the current as the bridging contact piece moves off the fixed contact piece.

BRIEF DESCRIPTION OF THE DRAWINGS

Further advantages and details of the invention will be described with reference to the drawings, in which.

Throughout the drawings, like elements are identified by like reference numerals.

DESCRIPTION OF A PREFERRED EMBODIMENT

Figure 1:
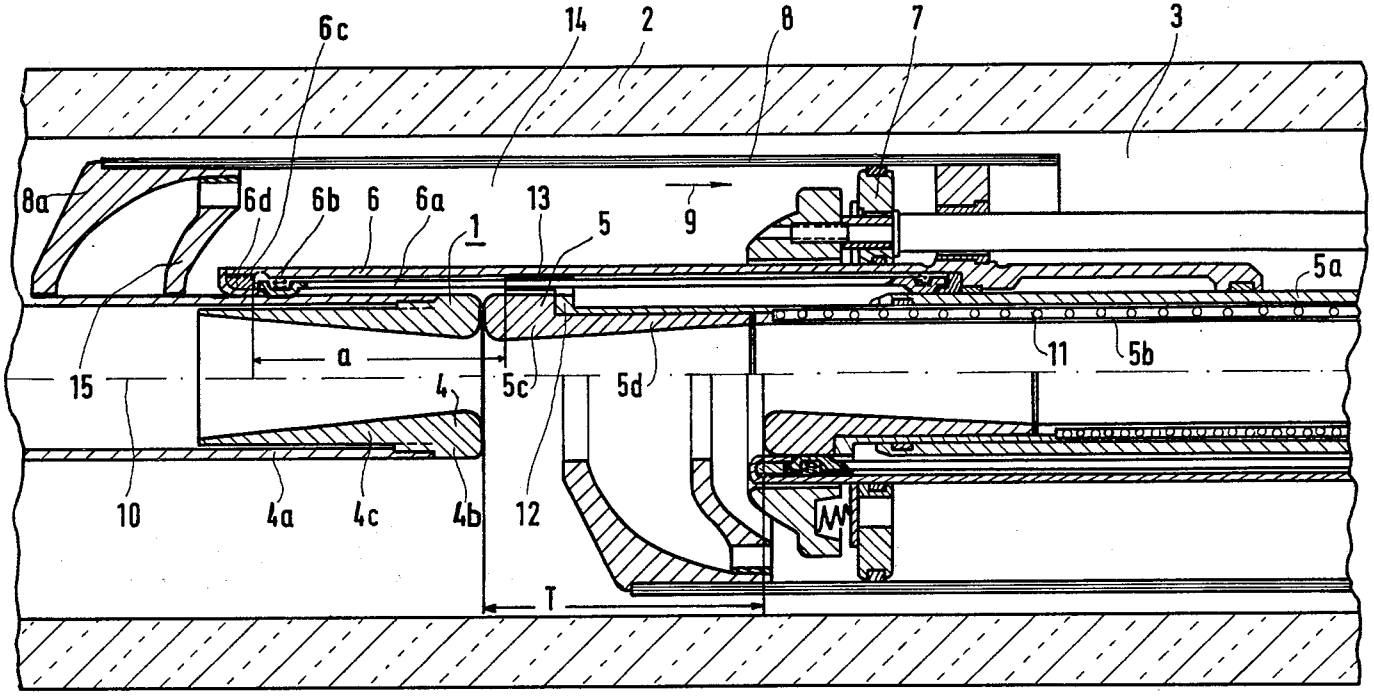
FIG. 1 is a schematic view in section of a gas blast circuit breaker in accordance with the invention shown in the make position above and in the break position below the dot-dash center line.

FIG. 1 shows schematically, in a section through the break unit of a gas blast circuit breaker, a contact system 1 according to the invention which is located centrally in a hollow cylinder 2 (the so-called "switch chamber") made of porcelain. The interior 3 of the hollow cylinder 2 is filled with sulfur hexafluoride as a quenching and insulating medium. The contact system 1 consists of a first nozzle-shaped contact piece 4 fixedly mounted within the cylinder 2. Coaxially disposed with respect thereto is a second nozzle-shaped contact piece 5 which is axially movable. A movable bridging contact piece 6 is mounted in a position common to both contact pieces 5 and 6.

The contact system 1 is shown in the environment of a gas blast circuit breaker of the type which operates on the blast piston principle, i.e. it has an arrangement composed of a piston 7 and a blast cylinder 8 which act to generate a flow of quenching gas. When the contact system 1 moves from the make position shown above the center line 10 to the break position shown below center line 10, the circuit breaker drive (not shown) moves the blast cylinder 8 in the direction of arrow 9 relative to the fixed piston 7. The bridging contact piece 6 is rigidly coupled to the blast cylinder 8 and thus moves likewise in the indicated direction.

The bridging contact piece 6 comprises an electrically conducting cylindrical sleeve, on which a plurality of contact fingers 6*a*, distributed uniformly over the circumference, take support in the interior with interposition of springs 6*b*. The contact fingers 6*a* are pushed by the respective springs 6*b* against the outer cylindrical surfaces of the contact pieces 4 and 5 in the make position.

The fixed nozzle-shaped contact piece 4 comprises a hollow cylindrical support 4*a*, having at its free end face a nozzle body 4*b* composed of graphite and an inner insert 4*c* made of ferromagnetic material.

The axially movable contact piece 5 comprises a hollow cylindrical support 5*a* in which a sliding tube 5*b* is telescopically guided. A compression spring 11 is provided between the sliding tube 5*b* and the support 5*a*. The spring 11 serves to press the nozzle body 5*c*, supported by the free end 12 of sliding tube 5*b*, against the corresponding nozzle body 4*b* in the make position. A nozzle part 5*d*, in the form of a hollow cone, abuts the nozzle body 5*c* of the contact piece 5. The part 5*d* may consist of graphite or at least partially of ferromagnetic material.

The free end 12 of the sliding tube 5*b* is equipped with an outwardly projecting stop 13, which is intended to contact a driver element provided in the region of the end face 6*c* of the bridging contact piece 6. The driving element may, for example, be a ring mounted on the end face of the bridging contact piece 6.

After the bridging contact piece 6 has passed through a stroke a in the direction of arrow 9 (which corresponds to the travel of the ring 6*d* from its rest position to its first position of contact with the stop 13), further travel in the same direction will drive the nozzle-shaped axially movable contact piece 5 against the force of the tensioning spring 11 into the break position.

The ring 6*d* and stop 13 are so constructed that the nozzle bodies 4*b* and 5*c* will separate after the bridging contact piece 6 has moved off the fixed contact piece 4. The arc will thus be drawn between the end-face contact edges of the nozzle bodies 4*b*, 5*c*.

The contact fingers 6*a* and other contact elements of the bridging contact piece 6 do not participate in the guiding of the arc, because at the time of the electrical separation of the contact pieces 4 and 5, the bridging contact piece has already been moved out of the arc area of the gap which is opening. The movement of the bridging contact piece 6 and of the blast cylinder 8, initiated by the time the nozzle bodies 4*b* and 5*c* separate, with respect to the relatively fixed piston, causes compression of the gas compressed in compression chamber 14, said gas flowing through the mutually separating nozzle bodies 4*b* and 5*c* into the interior thereof. The arc drawn inside the contact system is driven still further into the interior of the nozzles 4*b* and 5*c* under the influence of the gas flow and is extended thereby.

The selection of the distance between the contacts 4 and 5 (gap T), which determines the break position, is a matter of individual choice. The gap can be made relatively large without adversely affecting the flow of quenching gas through the double nozzle system (contact pieces 4, 5). For improved guiding of the quenching gas flow, the blast cylinder 8 is provided in the region of its free end face 82 with an intermediate bottom 15 which, together with the end face 6*c* of the bridging contact piece 6, forms an annular gas flow nozzle.

According to the invention, the contact system 1 is brought back to the make position from the break position shown below the center line 10 of FIG. 1 by movement of the breaker drive opposite to the direction of the arrow 9, whereby first the nozzle bodies 4*b* and 5*c* are pushed against each other and then the two contact pieces 4 and 5 are conductively bridged by the bridging contact piece 6.

Figure 2:
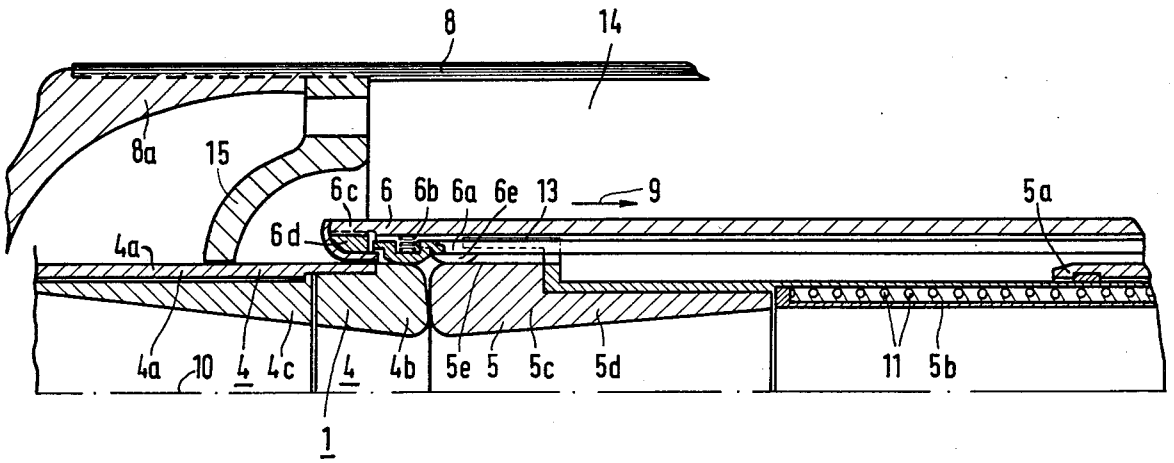
FIG. 2 is an enlarged schematic view in section of the upper half of the breaker of FIG. 1 shown in an intermediate position.

FIG. 2 shows the contact system 1 at an intermediate position in the course of the breaking movement. The bridging contact piece 6 is equipped with contact fingers 6*a*, with which shorter contact fingers 6*e* are associated in a regular distribution, e.g. three shorter fingers 6*e* over the circumference of the bridging contact piece 6. This arrangement serves to prepare the contact piece 5 for guiding the arc current after its separation from the contact piece 4. As the bridging contact piece 6 continues moving in the direction of arrow 9, the contact surfaces of the contact fingers 6*a* also reach the contact surface 5*e* of the bridging contact piece 5. This facilitates the switching of the current as the bridging contact piece 6 moves off the fixed contact piece 4. By selecting contact fingers 6*a* and 6*e* of different lengths, additional sliding contacts or current leads are unecessary because the beidging contact piece serves also to carry the current from the movable contact piece 5 to the fixed current carrier 5*a*.

Having thus described the invention with particular reference to a preferred form thereof, it will be obvious to those skilled in the art to which the invention pertains, after understanding the invention, that various changes and modifications may be made therein without departing from the spirit and scope of the invention as defined by the claims appended hereto. It will be appreciated that the selection, connection and layout of the various components of the described configuration may be varied to suit individual tastes and requirements.

What is claimed is:

1. A contact system for a gas blast circuit breaker, comprising a nozzle-shaped fixed first contact piece; a coaxially mounted nozzle-shaped, axially movable second contact piece; a movable bridging contact piece common to both the first and second contact pieces; and driving means for driving the system from a contact make position to a contact break position; characterized in that there is further provided spring biasing means for urging the second contact piece against the first contact piece in the contact make position; and wherein the driving means comprises means for separating the bridging contact piece from the first contact piece during the break process, before the second contact piece is separated from the first contact piece.

2. A contact system according to claim 1, further comprising a piston-cylinder arrangement for producing a quenching gas flow, and wherein the movable bridging circuit piece is rigidly connected to the cylinder.

3. A contact system according to claim 2, wherein the cylinder of the piston-cylinder arrangement has a free end face region which is provided with an inner intermediate bottom which forms an annular gas flow nozzle with the movable second contact piece.

4. A contact system according to one of claims 1 to 3, wherein the first and second contact pieces have free end faces provided with graphite bodies which are in contact in the make position.

5. A contact system according to one of claims 1 to 4, wherein the second contact piece and the bridging contact piece are electrically connected when the second contact piece is separated from first contact piece.

6. A contact element according to claim 5, wherein the bridging contact piece comprises a sleeve-shaped configuration having a plurality of spring-loaded contact fingers of different lengths, arranged in a uniform distribution over the configuration circumference; the fingers serving to electrically bridge the two contact pieces prior to separation of the second contact piece from the first contact piece.

7. An electrical contact system for a gas blast circuit breaker, comprising supporting structure;

a first nozzle-shaped contact piece fixedly mounted on the supporting structure;

a second nozzle-shaped contact piece mounted on the supporting structure for movement between a first position against the first contact piece and a second position separated from the first contact piece;

a bridging contact piece mounted on the supporting structure for movement between a first position in which it establishes an electrical connection between the first and second contact pieces and a second position in which it establishes no electrical connection between the first and second contact pieces; and means for driving the second contact piece and the bridging contact piece, so that when the system is brought from a contact make condition to a contact break condition, the second contact piece is driven from its first to its second position, after the bridging contact piece has been driven from its first to its second position;

whereby electrical contact of the second contact through the bridging contact to the first contact will be broken before the direct contact from the second contact to the first contact, so that arcing at break will extend between the first and second contacts.

8. An electrical contact system as defined in claim 7, further comprising means for biasing the second contact piece into its first position against the first contact piece; and the driving means further comprises means for driving the second contact piece against the force of the biasing means during the system break operation.

* * * * *